US009601095B2

(12) United States Patent
Tanabe

(10) Patent No.: US 9,601,095 B2
(45) Date of Patent: Mar. 21, 2017

(54) PERCUSSION SURFACE APPARATUS

(71) Applicant: Yamaha Corporation, Hamamatsu-shi, Shizuoka-ken (JP)

(72) Inventor: Emi Tanabe, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/084,355

(22) Filed: Mar. 29, 2016

(65) Prior Publication Data

US 2016/0293147 A1 Oct. 6, 2016

(30) Foreign Application Priority Data

Mar. 30, 2015 (JP) ..... 2015-068470
Mar. 17, 2016 (JP) ..... 2016-054082

(51) Int. Cl.

| | |
|---|---|
| ***G10H 1/32*** | (2006.01) |
| ***G10H 3/00*** | (2006.01) |
| ***G10D 13/02*** | (2006.01) |
| ***G10H 1/00*** | (2006.01) |
| ***G10H 3/14*** | (2006.01) |

(52) U.S. Cl.

CPC ..... *G10D 13/029* (2013.01); *G10D 13/024* (2013.01); *G10H 1/00* (2013.01); *G10H 3/146* (2013.01); *G10H 2230/00* (2013.01); *G10H 2230/251* (2013.01)

(58) Field of Classification Search

CPC ..... G10H 3/146; G10D 13/024; G10D 13/029
USPC ..... 84/743
See application file for complete search history.

(56) References Cited

U.S. PATENT DOCUMENTS 3,680,425 A * 8/1972 Morena ..... G10D 13/028 84/411 R
5,293,000 A * 3/1994 Adinolfi ..... G10D 13/024 84/730
5,854,436 A * 12/1998 Wernick ..... G10H 3/146 84/411 P
6,215,053 B1 * 4/2001 Adinolfi ..... G10D 13/027 84/411 R (Continued)

FOREIGN PATENT DOCUMENTS

| | | |
|---|---|---|
| EP | 2 722 238 A1 | 4/2014 |
| JP | 11-212566 A | 8/1999 |
| JP | 2005-227535 A | 8/2005 |

OTHER PUBLICATIONS

European Search Report mailed Jun. 30, 2016, for EP Application No. 16162584.3, seven pages.

*Primary Examiner* — Jeffrey Donels
(74) *Attorney, Agent, or Firm* — Morrison & Foerster LLP

(57) ABSTRACT

A percussion surface apparatus includes: a head which is formed by rubber, and which includes a front surface and a back surface, the front surface which functions as a percussion surface; a cushion member which includes: a first layer that is butted against the back surface of the head, and that is formed by a fiber-based non-woven fabric; and a second layer that is adjacent to the first layer, and that is formed by a porous urethane material; and a supporting unit which is configured to fix and support the cushion member in a state where the cushion member is butted against the back surface of the head at a pressure.

8 Claims, 6 Drawing Sheets

(56) References Cited

U.S. PATENT DOCUMENTS

| | | | | |
|---|---|---|---|---|
| 6,365,812 | B1 * | 4/2002 | McGill | G10D 13/027 84/413 |
| 6,756,535 | B1 * | 6/2004 | Yoshino | G10D 13/024 84/414 |
| 7,135,630 | B2 * | 11/2006 | Maruhashi | G10D 13/027 84/411 P |
| 7,816,597 | B2 | 10/2010 | Okada et al. | |
| 9,053,694 | B2 | 6/2015 | Kanayama et al. | |
| 2005/0211062 | A1 * | 9/2005 | Hiraku | G10D 13/024 84/414 |
| 2006/0219092 | A1 | 10/2006 | Mishima | |
| 2009/0241754 | A1 * | 10/2009 | Okada | G10D 13/029 84/414 |
| 2010/0282048 | A1 | 11/2010 | Hashimoto et al. | |
| 2014/0260918 | A1 | 9/2014 | Kanayama et al. | |
| 2015/0053068 | A1 * | 2/2015 | Miyata | G10D 13/029 84/723 |
| 2015/0053070 | A1 | 2/2015 | Miyata | |

* cited by examiner

Related Art

PERCUSSION SURFACE APPARATUS

CROSS-REFERENCE TO RELATED APPLICATION(S)

This application is based upon and claims the benefit of priority from prior Japanese patent applications No. 2015-068470, filed on Mar. 30, 2015 and 2016-054082, filed on Mar. 17, 2016, the entire contents of which are incorporated herein by reference.

BACKGROUND

The present invention relates to a percussion surface apparatus which can be applied to a practice percussion instrument or an electronic percussion instrument.

As a percussion surface apparatus which can be applied to a practice percussion instrument or an electronic percussion instrument, an apparatus is available which is configured so as to provide a percussion feeling that is similar to that of an acoustic percussion instrument (for example, see JP-A-11-212566).

FIG. 6(*a*) is a sectional view showing the configuration of the vicinity of the center of a head 100 of the percussion surface apparatus. In the vicinity of the center of the head 100, as shown in FIG. 6(*a*), a buffer member 101 is in contact with the rear side.

In the head 100, the percussion surface is configured by a net-like material. The buffer member 101 has a three-layer stack structure, and includes: an abrasion resistant layer 101*a* made of an abrasion resistant material; a low-elasticity layer 101*b* made of a low-elasticity material; and a high-elasticity layer 101*c* made of a high-elasticity material.

In order to absorb a percussion impact, the low-elasticity layer 101*b* is made of a low-elasticity material. Specifically, the low-elasticity layer is used for suppressing bounce of percussion caused by a beater, and excessive vibration of the vibration membrane, and improving the percussion feeling, and formed by a polyurethane sponge or the like. The high-elasticity layer 101*c* is a layer which is provided in order to, even when the low-elasticity layer 101*b* is compressively deformed by long-term percussion, maintain a state where the front end of the buffer member 101 is in contact with the head 100. When the low-elasticity layer 101*b* is directly struck by a beater through the head 100, the layer is abraded in a short period of time. The abrasion resistant layer 101*a* prevents the low-elasticity layer from being abraded. As the material of the abrasion resistant layer, a material which is abrasion resistant, and which is air-permeable to some extent so that, even when the material is struck by a beater, sound is hardly generated is suitably used. For example, a non-woven fabric or the like is employed.

In the related-art percussion surface apparatus, the percussion surface is configured by a net-like material or specifically a net-like fabric, and therefore has lower durability. In order to solve the problem, a percussion surface apparatus in which the head including a percussion surface is made of rubber has been used.

FIG. 6(*b*) is a sectional view showing an example of related-art percussion surface apparatus in which the head is made of rubber. Also in the percussion surface apparatus, a buffer member 111 having a three-layer stack structure is in contact with the rear side of the vicinity of the center of the head 110.

The buffer member 111 includes: an abrasion resistant layer 111*a* made of an abrasion resistant material; a low-elasticity layer 111*b* made of a low-elasticity material; and a high-elasticity layer 111*c* made of a high-elasticity material. Each of the three layers 111*a* to 111*c* is formed by a polyurethane sponge.

In the percussion surface apparatus, a percussion sensor 113 which detects vibrations of the head 110 is disposed on a sensor board 112 which is interposed between the low-elasticity layer 111*b* and the high-elasticity layer 111*c*.

In the related-art percussion surface apparatus, the rear surface of the head 110 is in contact with the low-elasticity layer 111*b* formed by a low-density polyurethane sponge, through the thin abrasion resistant layer 111*a*. Therefore, a struck part of the head 110 is extremely dented by percussion with a beater on the head, and, in accordance with this, also the low-elasticity layer 111*b* is dented. When the apparatus is used for a long term, as a result, a portion in the vicinity of the struck part of the low-elasticity layer 111*b* is compressively deformed, and the percussion feeling is impaired. In order to solve the problem, a percussion surface apparatus in which a plastic plate is interposed between the head and a buffer member has been used.

FIG. 6(*c*) is a sectional view showing an example of the related-art percussion surface apparatus which is configured as described above. A plastic plate 122 is interposed between the head 120 and a buffer member 121.

The buffer member 121 has a two-layer stack structure, and includes: a layer 121*a* which is formed by a polyurethane sponge; and a layer 121*b* which is formed by a nonwoven fabric.

In the percussion surface apparatuses of FIGS. 6(*a*) and 6(*c*), although not shown, a percussion sensor is disposed in a position which is remote from the buffer member 101 or 121.

In the above-described related-art percussion surface apparatuses, particularly in the percussion surface apparatus of FIG. 6(*b*) however, the layer 111 formed by a polyurethane sponge is in contact with the rear surface of the head 110, and, when weak percussion is applied to the head, it is therefore impossible to obtain light percussion feeling which may be obtained from an acoustic percussion instrument. This occurs because, in the case where a force (percussion) is applied to a polyurethane sponge, only a part to which the force is applied is deformed as shown in FIG. 5(*b*), the force is absorbed only by the part, and therefore a large reaction force is generated.

In the related-art percussion surface apparatus of FIG. 6(*c*), by contrast, the plastic plate 122 is disposed in front of the buffer member 121, and, when percussion is applied to the apparatus, the whole buffer member 121 is therefore compressed, so that a large reaction force is generated. Also in the related-art percussion surface apparatus, when weak percussion is applied to the head, namely, it is impossible to obtain light percussion feeling which may be obtained from an acoustic percussion instrument.

SUMMARY

The present invention may provide a percussion surface apparatus which, while maintaining high durability of a percussion surface, can further simulate percussion feeling of an acoustic percussion instrument.

The percussion surface apparatus may comprise: a head which is formed by rubber, and which includes a front surface and a back surface, the front surface which functions as a percussion surface; a cushion member which includes: a first layer that is butted against the back surface of the head, and that is formed by a fiber-based non-woven fabric; and a second layer that is adjacent to the first layer, and that is formed by a porous urethane material; and a supporting unit which is configured to fix and support the cushion member in a state where the cushion member is butted against the back surface of the head at a pressure.

A density of the first layer may be lower than a density of the second layer.

The cushion member may further include a third layer that is adjacent to the second layer, and that is formed by a porous urethane material which is higher in density than the porous urethane material of the second layer.

The densities of at least the first to third layers may be set so that a dented amount of a struck part is linearly changed in accordance with a strength of percussion against the head.

The percussion surface apparatus may further comprise: a sensor board which is interposed between the second layer and the third layer; and a percussion sensor which is disposed on the sensor board.

DETAILED DESCRIPTION OF EXEMPLARY EMBODIMENTS

Hereinafter, an embodiment of the invention will be described in detail with reference to the drawings.

Figure 1B:
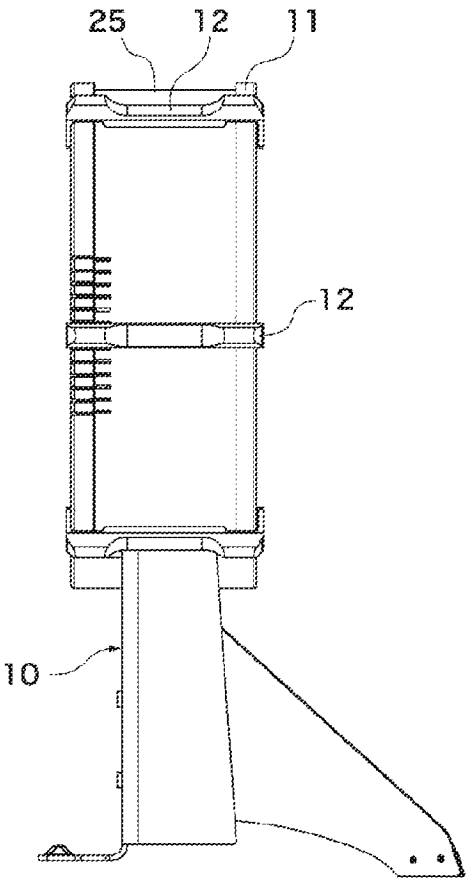
FIG. 1(*a*) is a front view of an electronic percussion instrument to which a percussion surface apparatus of an embodiment of the invention is applied, and FIG. 1(*b*) is a side view of the instrument.
Figure 1A:
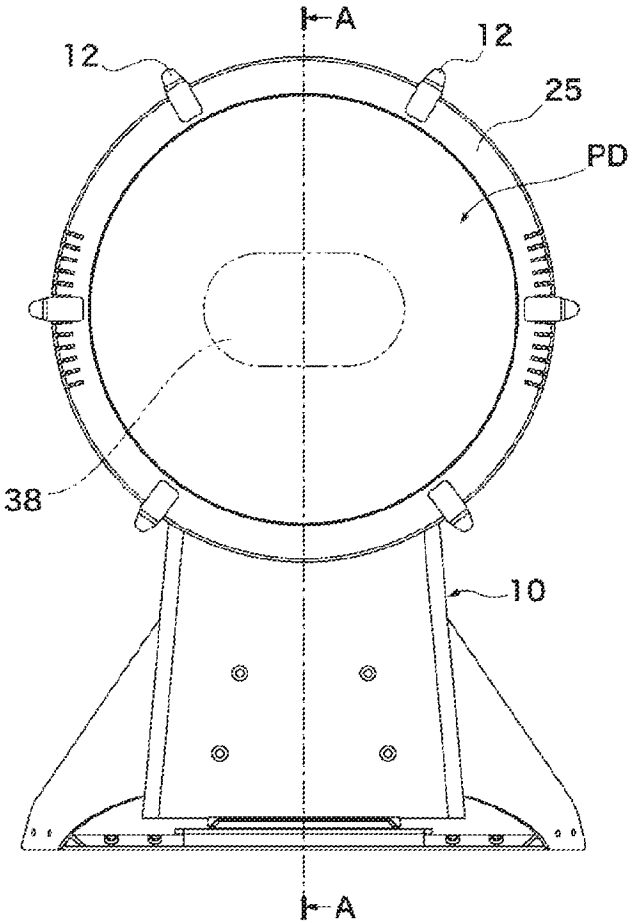

FIGS. 1(*a*) and 1(*b*) are front and side views of an electronic percussion instrument using a pad member PD to which a percussion surface apparatus of an embodiment of the invention is applied, respectively.

The electronic percussion instrument is configured as an electronic bass drum in which the drum body functioning as a kick pad is supported by a stand 10. Although not shown, a foot pedal device is attached to the player s side of the electronic percussion instrument. Hereinafter, the directions (upward, downward, rightward, and leftward) of the electronic percussion instrument are determined with respect to the players s view (the front view of FIG. 1 (*a*)). The forward and rearward directions are determined assuming that the side of the player is the front side.

A usual foot pedal device is attached to the instrument. When a pedal is operated, a beater 60 (see FIG. 4(*a*) which will be described later) of the device strikes the pad member PD of the drum body. The foot pedal device may be configured so as to have a single beater. In the embodiment, however, the foot pedal device is of the two-pedal type, and configured so that two beaters are independently operated. Therefore, the foot pedal device is disposed so that the beaters strike the right and left sides with respect to the center in the front view of the main percussion area 38 which is to be mainly struck in the pad member PD having a circular shape, respectively.

Figure 2:
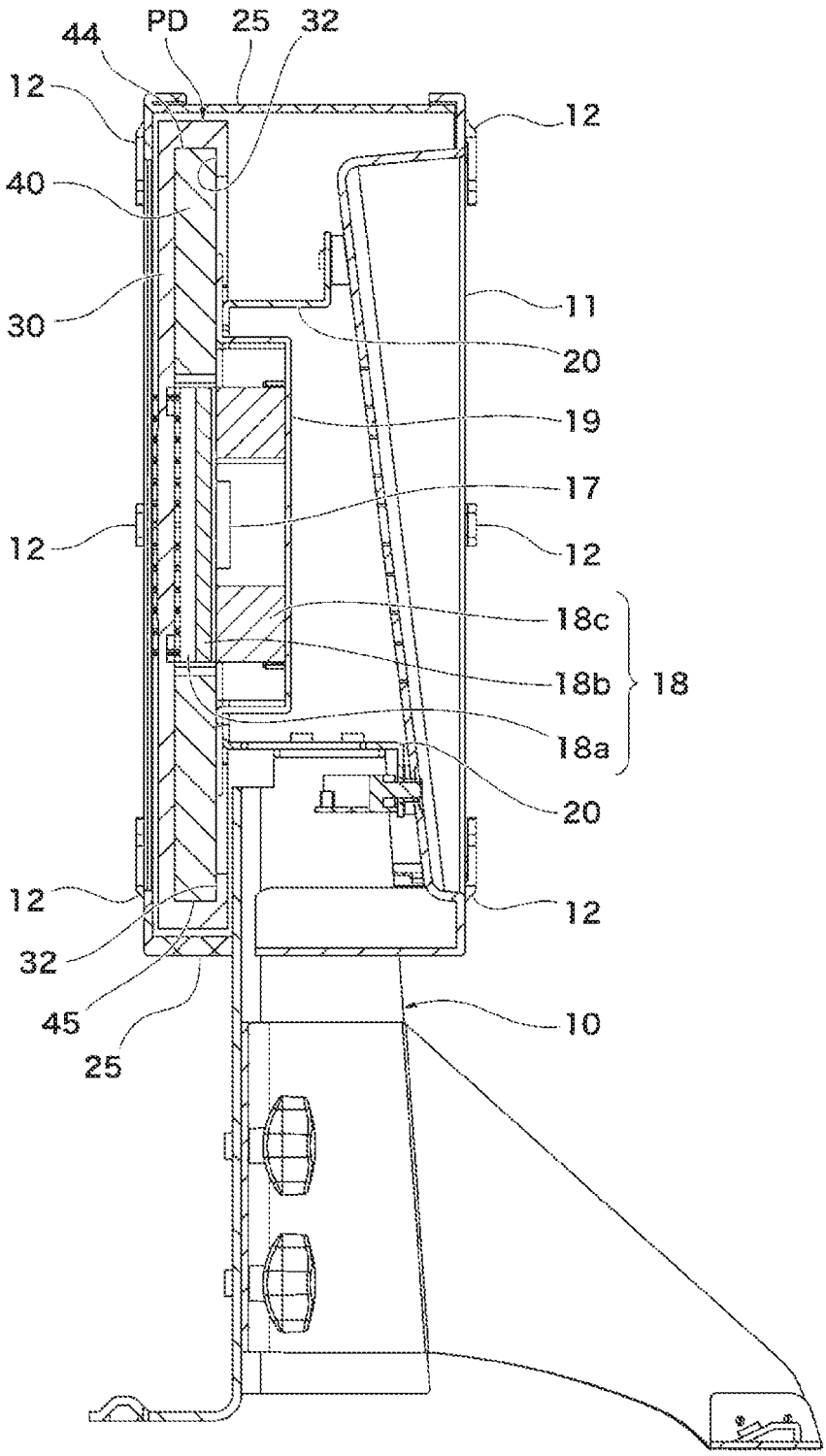
FIG. 2 is a sectional view taken along line A-A in FIG. 1(*a*).

FIG. 2 is a sectional view taken along line A-A in FIG. 1(*a*).

As shown in FIG. 2, a metal-made stay 20 is fixed to the stand 10. The pad member PD is fixed to the front side of the stay 20 through a flange of a cushion-holding member 19.

A back cover 11 is fixed to upper and lower back surfaces of the stay 20. A substantially cylindrical front cover 25 is fixed to the back cover 11. The front cover 25 is fixed to the back cover 11 in six places along the circumferential direction by hook members 12. The outer circumferential side of the pad member PD is covered by the front cover 25.

The pad member PD includes: a head portion 30 which is integrally formed by an elastic material or specifically rubber; and a frame 40 made of a resin and the like. The head portion 30 is made of a material which is softer and more elastic than the material of the frame 40.

The electronic percussion instrument is assembled in the following manner.

Referring to FIG. 2, the stay 20 is screw-fixed to an upper portion of the stand 10. A cushion layer 18 in which layers are stacked in the anteroposterior direction is fixed to the cushion-holding member 19. The flange of the cushion-holding member 19, and the stay 20 are screw-fixed to the back surface of the frame 40 of the pad member PD.

The pad member PD is attached in the following manner.

Firstly, the back surface side of the head portion 30 is opposed to the front side of the frame 40. Upper and lower folded portions 32 are engaged with peripheral portions 44, 45 of the the frame 40 so that the folded portions 32 cover the peripheral portions 44, 15 from the outside, respectively.

When the head portion 30 is attached to the frame 40 as described above, the pad member PD is completed. A stretchable protective member 31 (see FIG. 3(*a*) which will be described later) made of a knit material or the like is applied so as to cover the whole front surface of the head portion 30.

When the pad member PD is fixed to the stay 20 and the cushion-holding member 19, the front surface of the cushion layer 18 is opposingly butted against the back surface (particularly, the back surface of the main percussion area 38) of the head portion 30 at a predetermined pressure.

Next, the back cover 11 is screw-fixed to the back surfaces of upper and lower portions of the stay 20. Then, an edge portion of the front cover 25 is fitted from the front side into the inside of an edge portion of the back cover 11, and the back cover 11 and the front cover 25 are anteroposteriorly sandwiched by the six hook members 12. Thereafter, screws are fastened from the rear side to rear portions of the hook members 12 against the back cover 11. The forward pressing of the back cover 11 by the tip ends of the screws causes the front portions of the hook members 12 to rearwardly urge the front cover 25. In this way, the front cover 25 is fixed to the back cover 11.

The front cover 25 covers the pad member PD from the outer circumferential side, but is not butted against the pad member PD itself. Namely, the pad member PD is supported by the stand 10 via the stay 20, and the front cover 25 is not concerned with the support of the pad member PD. The fixation of the back cover 11 and the front cover 25 may be performed by any method, and the hook members 12 are not essential. The back cover 11 and the front cover 25 may be formed as an integral cover.

In the embodiment, the foot pedal device having a twin-beater configuration is used, and therefore the main percussion area 38 has a laterally elongated circular shape as shown in FIG. 1(*a*).

In the above-described configuration, when the main percussion area 38 of the head portion 30 is struck by the beater 60, the head portion 30 vibrates, and the vibration is transmitted to a percussion sensor 17 through first and second layers 18*a*, 18*b* of the cushion layer 18. The percussion sensor 17 converts the received vibration to an electric signal (voltage), and outputs the signal as a detection signal. When the detection signal exceeds a predetermined threshold, it is detected that percussion is applied. In accordance with the detection result, i.e., at a timing based on the detection timing, and with a volume corresponding to the level of the detection signal, music sound is generated by a music sound generating mechanism which is not shown.

Figure 3A:
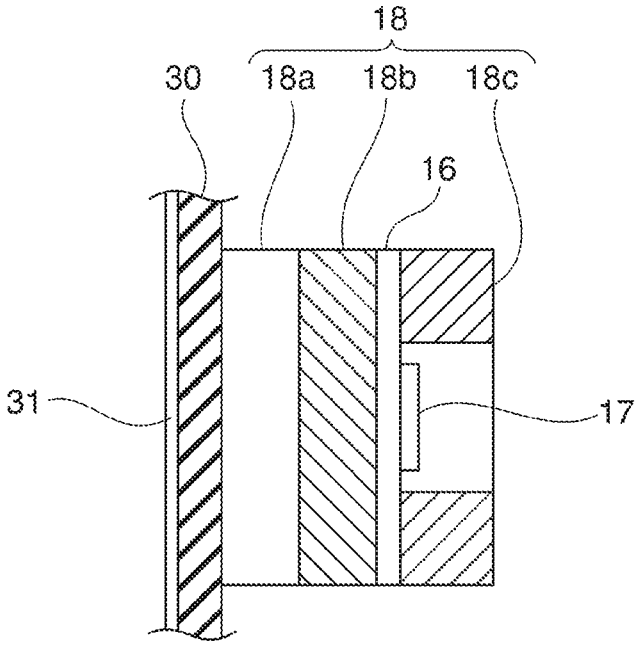
FIG. 3(*a*) is a view showing the configuration of a cushion layer in FIG. 2 and the vicinity thereof, and FIG. 3(*b*) is a view showing characteristics of an amount of displacement with respect to a strength of a force in a case where the force is applied to a fiber-based non-woven fabric and polyurethane sponges having the same density, as shown in FIGS. 5(*a*) and 5(*b*)
Figure 3B:
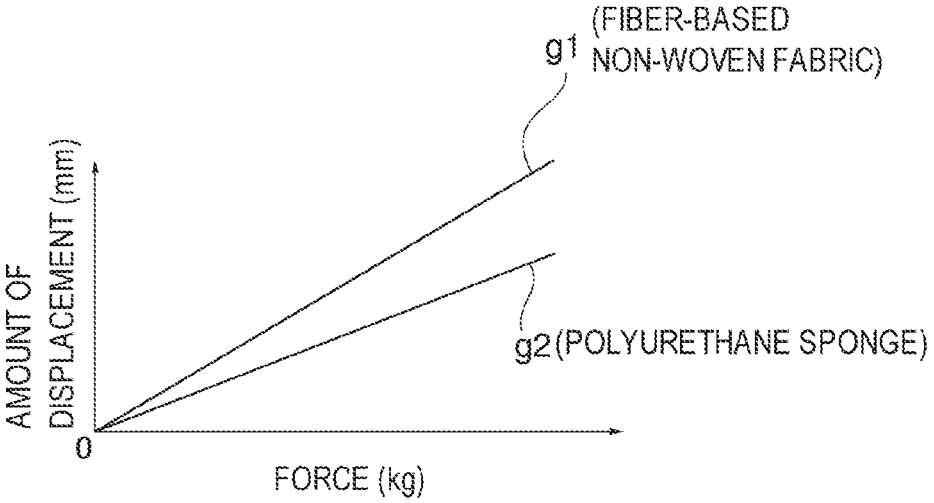

FIG. 3(*a*) is a view showing the configuration of the cushion layer 18 and the vicinity thereof.

As shown in FIG. 3(*a*), the cushion layer 18 has a three-layer stack structure. The first layer 18*a* is formed by a fiber-based non-woven fabric, the second layer 18*b* is formed by a polyurethane sponge, and the third layer 18*c* is formed by a polyurethane sponge which is higher in density than the polyurethane sponge of the second layer 18*b*.

The fiber-based non-woven fabric of the first layer 18*a* has a cotton-like form in which independent fibers are irregularly entangled. As the fabric, a fabric in which the material is ester-based, the density is 10 to 50 kg/m$^3$, and the thickness is 5.0 mm or more is employed.

Figure 5A:
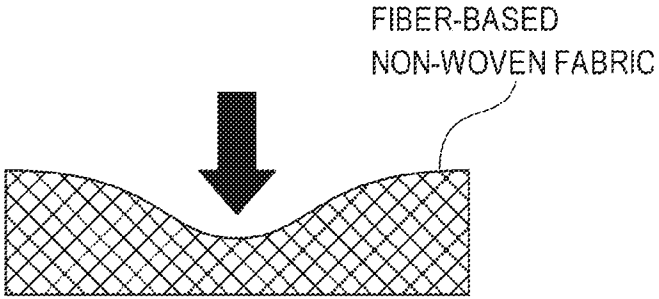
FIGS. 5(*a*) and 5(*b*) are views showing manners in which a fiber-based non-woven fabric (FIG. 5(*a*)) and a polyurethane sponge (FIG. 5(*b*)) are deformed when forces of the same strength are applied to the materials, respectively.
Figure 5B:
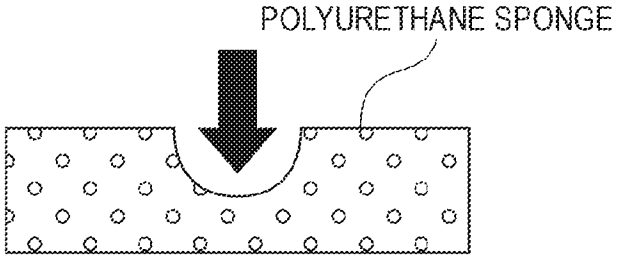
Figure 6A:
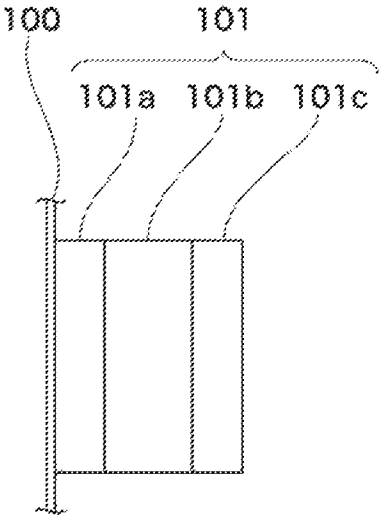
FIGS. 6(*a*) to 6(*c*) are sectional views respectively showing configurations of vicinities of the centers of the heads of related-art percussion surface apparatuses.
Figure 6B:
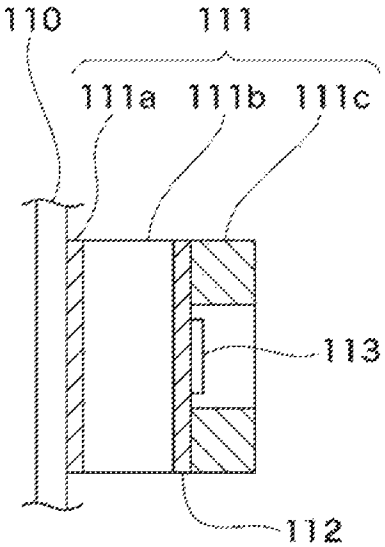
Related Art Fig.6(b)
Figure 6C:
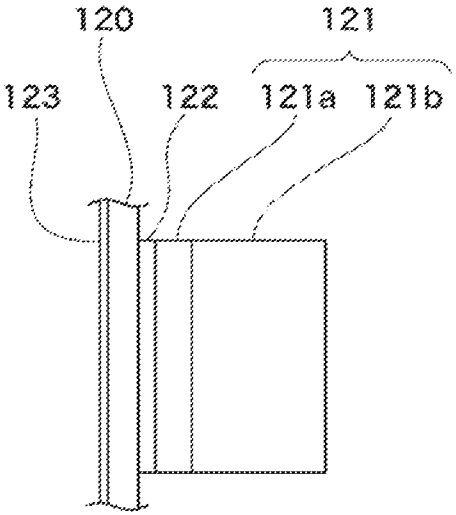
Related Art Fig.6(c)

FIG. 3(*b*) is a view showing characteristics of the amount of displacement with respect to the strength of a force in the case where the force is applied to a fiber-based non-woven fabric and polyurethane sponges having the same density, as shown in FIGS. 5(*a*) and 5(*b*).

In FIG. 3(*b*) the graph g1 shows characteristics of the fiber-based non-woven fabric, and the graphs g2 shows characteristics of the polyurethane sponges. As shown in FIG. 3(*b*), the amount of displacement (dented amount) with respect to the strength of a force is linearly changed in a similar manner in both the cases of a fiber-based non-woven fabric and a polyurethane sponge. In a fiber-based non-woven fabric, however, the amount of displacement with respect to the same strength of a force is larger than that in a polyurethane sponge. This characteristic shows that the reaction force to a force applied to a fiber-based non-woven fabric is smaller than that applied to a polyurethane sponge.

FIGS. 5(*a*) and 5(*b*) are views respectively showing manners in which a fiber-based non-woven fabric (FIG. 5(*a*)) and a polyurethane sponge (FIG. 5(*b*)) are deformed when forces of the same strength is applied to the materials.

In a polyurethane sponge, as shown in FIG. 5(*b*), only part to which a force is applied is deformed, and therefore the force is absorbed by only the part. In a fiber-based non-woven fabric, by contrast, as shown in FIG. 5(*a*), an extended area centered at a part to which a force is applied is deformed, and therefore the force escapes through an area other than the part to which the force is applied. As a result, even when forces of the same strength are applied to a fiber-based non-woven fabric and a polyurethane sponge, respectively, therefore, different reaction forces are generated. The reaction force exerted by the fiber-based non-woven fabric is weaker than that exerted by the polyurethane sponge.

Returning to FIG. 3(*a*), a sensor board 16 made of a resin or the like is interposed between the second layer 18*b* and the third layer 18*c*, and the percussion sensor 17 is disposed on the sensor board 16.

As described above, the cushion layer 18 is opposingly butted against the back surface of the head portion 30 at the percussion surface pressure, and the stretchable protective member 31 is adhered to the surface (rubber surface) of the head portion 30.

Figure 4A:
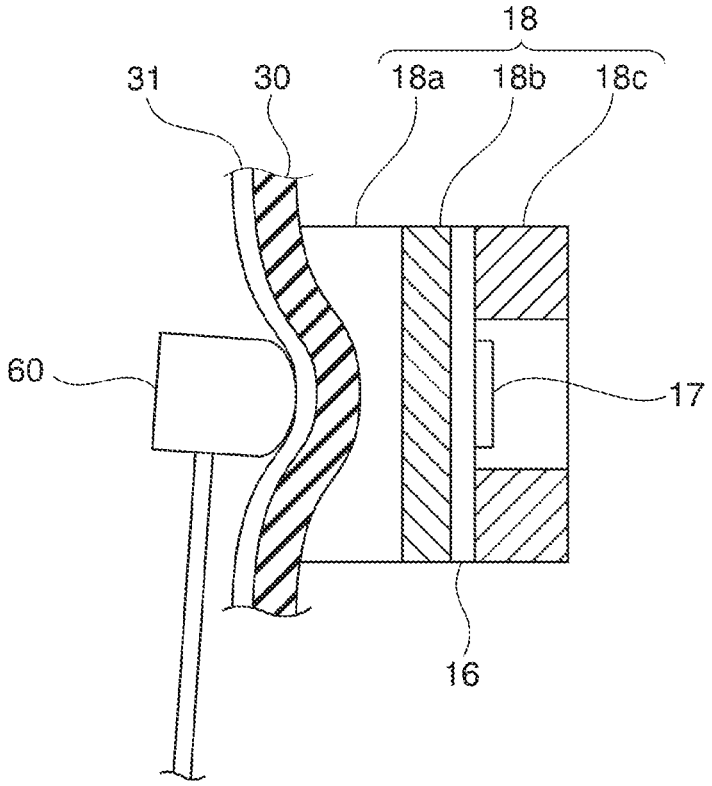
FIG. 4(*a*) is a view showing a manner in which, when a head portion is struck by a beater, the head portion and the vicinity thereof are changed, and FIG. 4(*b*) is a view showing characteristics of a dented amount of a struck part with respect to a percussion strength.
Figure 4B:
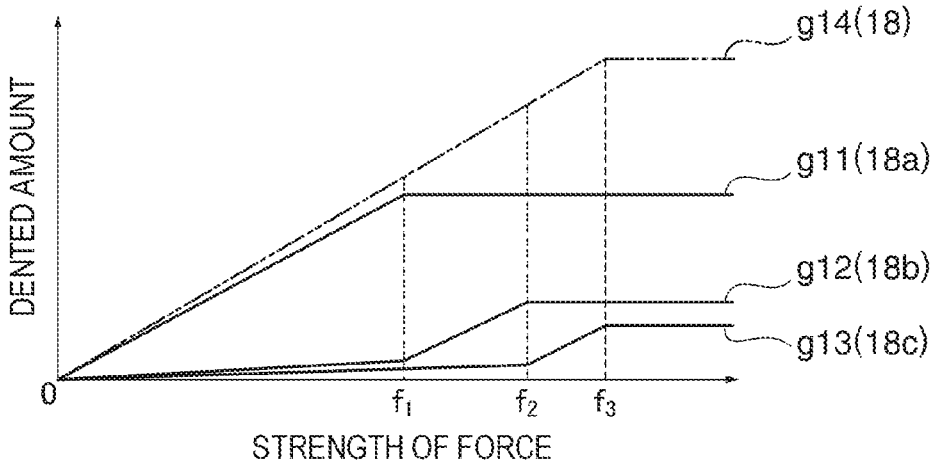

FIG. 4(*a*) is a view showing a manner in which, when the head portion 30 is struck by the beater 60, the head portion 30 and the vicinity thereof are deformed, and FIG. 4(*b*) is a view showing characteristics of a dented amount of a struck part with respect to a percussion strength.

When the head portion 30 is struck by the beater 60, the struck part of the head portion 30 is dented as shown in FIG. 4(*a*), and affects the cushion layer 18. In the illustrated example, the manner in which the denting is restricted within the first layer 18*a* is shown.

As shown by the dashed two dotted line g14 in FIG. 4(*b*) the dented amount of the whole cushion layer 18 is linearly changed in accordance with the strength of a force. More properly, the cushion layer 18 is configured so as to obtain the linear characteristics as follows. Namely, the linear characteristics are obtained by: setting the relationship of the density of the first layer 18*a*<that of the second layer 18*b*<that of the third layer 18*c*; and designing the densities, thicknesses, and the like of the layers 18*a* to 18*c* so that, when weak percussion is applied, the first layer 18*a* is preferentially or independently deformed, when medium percussion is applied, the second layer 18*b* is preferentially or independently deformed, and, when strong percussion is applied, only the third layer 18*c* is deformed.

In FIG. 4(*b*), characteristics of a dented amount of each of the first layer 18*a*, the second layer 18*b* and the third layer 18*c* with respect to the percussion strength is shown by the solid lines g11, g12 and g13. The range 0 to f1 of the strength of a force (percussion strength) corresponds to the weak percussion, the range f1 to f2 corresponds to the medium percussion, and the range f2 to f3 corresponds to the strong percussion, in FIG. 4(*b*).

In the range 0 to f1 of the strength of the force, as shown by the solid line g11, the first layer 18*a* is preferentially or independently, and linearly dented, and the second layer 18*b* and the third layer 18*c* are slightly dented, however the dented amounts of the second layer 18*b* and the third layer 18*c* are small degrees. In the range f1 to f2, since the first layer 118*a* is in a state where the first layer 18*a* is maximally contracted, the first layer 18*a* is not dented anymore. Instead of the first layer 18*a*, in the range, the second layer 18*b* is preferentially or independently, and linearly dented, and the third layer 18*c* is slightly dented, however the dented amount of the third layer 18*c* is small degree. In the range f2 to f3, since the first layer 18*a* and the second layer 18*b* are in a state where they are maximally contracted, they are not dented anymore. Instead of them, in the range, only the third layer 18*b* is linearly dented. A percussion strength that is stronger than f3 is assumed, however, since the first layer 18*a*, the second layer 18*b* and the third layer 18*c* are in a state where they are maximally contracted in the percussion strength, anymore denting is not generated.

In FIG. 4(*b*), the solid line g14 shows liner characteristics obtained by combining the characteristics of the lines g11 to g13. Thus, the densities, thicknesses, and the like of the layers 18*a* to 18*c* are designed so that the characteristics of the layers 18*a* to 18*c* show the lines g11 to g13, respectively, therefore, the dented amount of the whole cushion layer 18 is linearly changed in accordance with the strength of a force.

In the characteristics shown in FIG. 4(*b*), when the dented amount reaches a predetermined value, the amount is not further increased because the upper limit of the dented amount is obtained in the state where the third layer 18*c* (and the sensor board 16) is maximally contracted. It is described that the lines g11 to g14 are linearly changed, and the characteristics of them are precipitously changed at points f1 to f3, respectively, in FIG. 4(*b*). However, in the invention, in accordance with the designs of the densities, thicknesses, and the like of layers 18*a* to 18*c*, it can be assumed that the lines g11 to g14 are changed with gentle curvature, and the characteristics of them are gently changed before and after points f1 to f3.

In the embodiment, as described above, the head portion 30 made of rubber is employed, and, as the cushion layer 18 which is opposingly butted against the back surface of the head portion 30, the structure including: the first layer 18*a* which is butted against the back surface, and which is formed by a fiber-based non-woven fabric; and the second layer 18*b* which is adjacent to the first layer 18*a*, and which is formed by a polyurethane sponge is disposed. As a result, the high durability of the percussion surface which is due to the employment of the head portion 30 made of rubber can be maintained. Moreover, the reaction force to a percussion force is reduced by the employment of the fiber-based non-woven fabric in the first layer 18*a*. When weak percussion is applied to the head portion, therefore, light percussion feeling is obtained, and hence it is possible to further simulate percussion feeling of an acoustic percussion instrument.

Even when a struck part is dented in accordance with percussion, the fiber-based non-woven fabric which is used in the first layer 118*a* is deformed while extending centered at the struck part. Even though the apparatus is used for a long term, therefore, a state where only the struck part is dented is not formed. Consequently, impairment of percussion feeling due to a situation where the struck part remains dented and does not return to the original shape can be prevented from occurring.

What is claimed is:

1. A percussion surface apparatus comprising:

a head which is formed by rubber, and which includes a front surface and a back surface, the front surface which functions as a percussion surface;

a cushion member which includes:

a first layer that is butted against the back surface of the head, and that is formed by a fiber-based non-woven fabric, and a second layer that is adjacent to the first layer, and that is formed by a porous urethane material, wherein a density of the first layer is lower than a density of the second layer; and a supporting unit which is configured to fix and support the cushion member in a state where the cushion member is butted against the back surface of the head at an amount of pressure.

2. The percussion surface apparatus according to claim 1, wherein the cushion member further includes a third layer that is adjacent to the second layer, and that is formed by a porous urethane material which is higher in density than the porous urethane material of the second layer.

3. The percussion surface apparatus according to claim 2, wherein the densities of at least the first to third layers are set so that a dented amount of the cushion member is linearly changed in accordance with a strength of percussion against the head.

4. The percussion surface apparatus according to claim 2, further comprising:

a sensor board which is interposed between the second layer and the third layer; and a percussion sensor which is disposed on the sensor board.

5. A percussion surface apparatus comprising:

a pad member which includes:

a head which is formed by rubber, and which includes a front surface and a back surface, the front surface which functions as a percussion surface, and a frame to which the head is attached, and which includes a front surface and a back surface;

a cushion member which includes:

a first layer that is butted against the back surface of the head, and that is formed by a fiber-based non-woven fabric, and a second layer that is adjacent to the first layer, and that is formed by a porous urethane material, wherein a density of the first layer is lower than a density of the second layer; and a cushion-holding member to which the cushion member is fixed, the cushion-holding member fixed to the back surface of the frame of the pad member.

6. The percussion surface apparatus according to claim 5, wherein the cushion member further includes a third layer that is adjacent to the second layer, and that is formed by a porous urethane material which is higher in density than the porous urethane material of the second layer.

7. The percussion surface apparatus according to claim 6, wherein the densities of at least the first to third layers are set so that a dented amount of the cushion member is linearly changed in accordance with a strength of percussion against the head.

8. The percussion surface apparatus according to claim 6, further comprising:

a sensor board which is interposed between the second layer and the third layer; and a percussion sensor which is disposed on the sensor board.

* * * * *